US005842484A

United States Patent [19]

Longsworth

[11] Patent Number: 5,842,484

[45] Date of Patent: Dec. 1, 1998

[54] HAIR FASHION ACCESSORY

[76] Inventor: Rosita Longsworth, P.O. Box 610791, Miami, Fla. 33261

[21] Appl. No.: 857,739

[22] Filed: May 16, 1997

[51] Int. Cl.[6] ..... A45D 8/12

[52] U.S. Cl. ..... 132/275; 132/276; 132/277; 132/278; 132/279

[58] Field of Search ..... 132/273, 275, 132/276, 277, 278, 282; D28/39, 40, 41

[56] References Cited

U.S. PATENT DOCUMENTS

| | | | |
|---|---|---|---|
| 1,110,446 | 9/1914 | Lange | 132/275 |
| 1,255,348 | 2/1918 | Stone | 132/275 |
| 1,313,137 | 8/1919 | Tarnow | 132/275 |
| 1,353,912 | 9/1920 | Kelley | 132/275 |
| 1,374,524 | 4/1921 | Preston | 132/273 |
| 1,808,156 | 6/1931 | Burns | 132/273 |
| 3,842,849 | 10/1974 | Goodman | 132/273 |
| 5,566,690 | 10/1996 | Shih-Ming | 132/276 |

*Primary Examiner*—Gene Mancene
*Assistant Examiner*—Philogene Pedro

[57] ABSTRACT

A new hair fashion accessory for holding hair in place while at the same time enhancing the appearance of the wearer. The inventive device includes an elongated member having a first surface and a second surface, a clip attached to the first surface for securing the elongated member to the hair, and an arcuate fastener attached to the support member for releasably securing a bow to the second surface. The bow can be replaced with a different bow by releasing the arcuate fastener, removing the bow, and inserting the new bow between the fastener and the second surface. The fastener is then reattached so as to secure the new bow.

9 Claims, 2 Drawing Sheets

HAIR FASHION ACCESSORY

BACKGROUND OF THE INVENTION

1. Field of the Invention

The present invention relates to hair accessories and more particularly pertains to a new hair fashion accessory for holding hair in place while at the same time enhancing the appearance of the wearer.

2. Description of the Prior Art

The use of hair accessories is known in the prior art. More specifically, hair accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art hair accessories include U.S. Pat. No. 4,910,051; U.S. Pat. No. 4,819,671; and U.S. Pat. No. 5,379,782. Additionally, prior art bows are disclosed in U.S. Pat. No. 4,278,714; U.S. Pat. No. Des. 313,373; and U.S. Pat. No. Des. 342,464.

While these devices fulfill their respective, particular objectives and requirements, the aforementioned patents do not disclose a new hair fashion accessory. The inventive device includes an elongated member having a first surface and a second surface, a clip attached to the first surface for securing the elongated member to the hair, and an arcuate fastener attached to the support member for releasably securing a bow to the second surface. The bow can be replaced with a different bow by releasing the arcuate fastener, removing the bow, and inserting the new bow between the fastener and the second surface. The fastener is then reattached so as to secure the new bow.

In these respects, the hair fashion accessory according to the present invention substantially departs from the conventional concepts and designs of the prior art, and in so doing provides an apparatus primarily developed for the purpose of holding hair in place while at the same time enhancing the appearance of the wearer.

SUMMARY OF THE INVENTION

In view of the foregoing disadvantages inherent in the known types of hair accessories now present in the prior art, the present invention provides a new hair fashion accessory construction wherein the same can be utilized for holding hair in place while at the same time enhancing the appearance of the wearer.

The general purpose of the present invention, which will be described subsequently in greater detail, is to provide a new hair fashion accessory apparatus and method which has many of the advantages of the hair accessories mentioned heretofore and many novel features that result in a new hair fashion accessory which is not anticipated, rendered obvious, suggested, or even implied by any of the prior art hair accessories, either alone or in any combination thereof.

To attain this, the present invention generally comprises an elongated member having a first surface and a second surface, a clip attached to the first surface for securing the elongated member to the hair, and an arcuate fastener attached to the support member for releasably securing a bow to the second surface. The bow can be replaced with a different bow by releasing the arcuate fastener, removing the bow, and inserting the new bow between the fastener and the second surface. The fastener is then reattached so as to secure the new bow.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new hair fashion accessory apparatus and method which has many of the advantages of the hair accessories mentioned heretofore and many novel features that result in a new hair fashion accessory which is not anticipated, tendered obvious, suggested, or even implied by any of the prior art hair accessories, either alone or in any combination thereof.

It is another object of the present invention to provide a new hair fashion accessory which may be easily and efficiently manufactured and marketed.

It is a further object of the present invention to provide a new hair fashion accessory which is of a durable and reliable construction.

An even further object of the present invention is to provide a new hair fashion accessory which is susceptible of a low cost of manufacture with regard to both materials and labor, and which accordingly is then susceptible of low prices of sale to the consuming public, thereby making such hair fashion accessory economically available to the buying public.

Still yet another object of the present invention is to provide a new hair fashion accessory which provides in the apparatuses and methods of the prior art some of the advantages thereof, while simultaneously overcoming some of the disadvantages normally associated therewith.

Still another object of the present invention is to provide a new hair fashion accessory for holding hair in place while at the same time enhancing the appearance of the wearer.

Yet another object of the present invention is to provide a new hair fashion accessory which includes an elongated member having a first surface and a second surface, a clip attached to the first surface for securing the elongated member to the hair, and an arcuate fastener attached to the support member for releasably securing a bow to the second surface.

Still yet another object of the present invention is to provide a new hair fashion accessory that permits replaceable attachment of bows thereto, so that the appearance of the wearer can be easily changed by replacing the bow.

Even still another object of the present invention is to provide a new hair fashion accessory that is useable with a variety of different hairstyles for enhancing each hairstyle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1A:
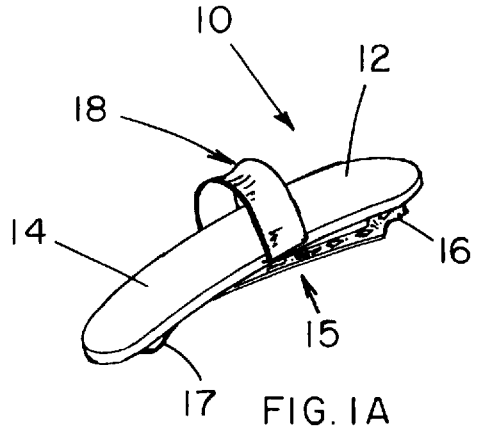
FIG. 1A is a perspective view of the hair fashion accessory according to the present invention.

With reference now to the drawings, and in particular to FIGS. 1 through 6 thereof, a new hair fashion accessory embodying the principles and concepts of the present invention and generally designated by the reference numeral 10 will be described.

Figure 1B:
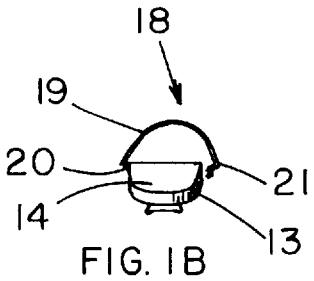
FIG. 1B is an end view of the embodiment shown in FIG. 1A.

As best illustrated in FIGS. 1A–B, the hair fashion accessory 10 comprises an elongated member 12 made of a generally rigid material, such as plastic. The member 12 includes a first flat, bottom surface 13 and a second flat, top surface 14 generally parallel to the surface 13. Spring clip 15 is attached to the bottom surface 13 and is used to secure the member 12 to a person's hair. The clip 15 is typical of many clips which are found on hair fashion accessories, such as barrettes, and includes a first end 16 which is rigidly secured to the member, such as by a small rivet (not shown). The second end 17 of the clip 15 is either releasably connected to the bottom surface by appropriate means (not shown), as is common in a typical barrette, or is in spring loaded contact with the bottom surface. In either case, the hair is slid under the second end 17 so that the hair is disposed between the clip and the bottom surface 13, which secures the member to the person's hair.

A fastening member 18 is also attached to the member 12 so that it is generally disposed above the top surface 14. The fastening member comprises a generally arcuate, plastic member having a first end 19 connected by a hinge 20 to the side of the member 12 so that the member 18 is able to pivot about the hinge 20. As illustrated in FIGS. 1A and 1B the hinge 20 is a live hinge made of plastic which is integrally molded with the members 12 and 18 so as to permit pivoting movement of the member 18 relative to the member 12. The member 18 also includes a second end 21 which is releasably secured to the member 12, such as by a push button release attachment mechanism. In use, the end 21 is released and the member 18 is pivoted such that a bow can be inserted between the member 18 and the surface 14. The member 18 is then pivoted to the closed position and the end 21 reattached so as to secure the bow in place.

Figure 2A:
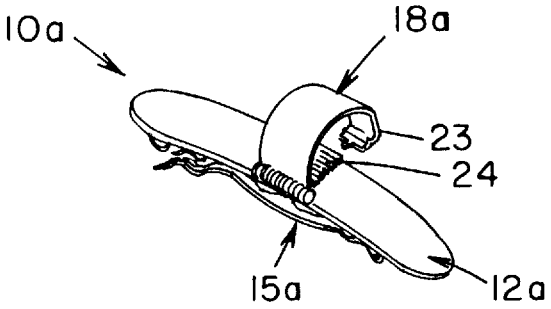
FIG. 2A is a perspective view of another embodiment of the invention.
Figure 2B:
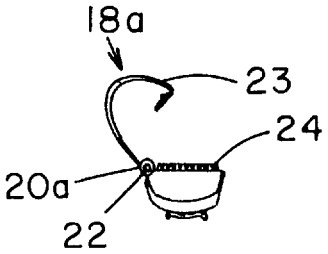
FIG. 2B is an end view of the accessory shown in FIG. 2A.

FIGS. 2A and 2B illustrate an accessory 10A which is generally similar to the accessory 10 of FIGS. 1A–B, except that the hinge 20*a* comprises a standard hinge which includes a pivot pin 22 for pivotally securing the member 18*a* to the member 12*a*. The opposite end 23 of the member 18*a* is also releasably attached to the member 12*a* by an attachment mechanism that requires a manual deformation of the end 18 to release the connection. Additionally, a plurality of projecting teeth 24 are formed on the top surface generally underneath the member 18*a* in order to prevent bow slippage when the bow is clamped between the members 18*a* and 12*a*.

Figure 3A:
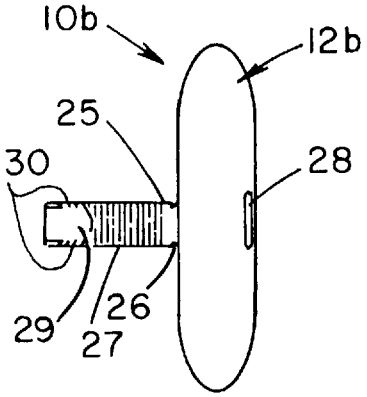
FIG. 3A is a top view of yet another embodiment of the hair fashion accessory according to the present invention.
Figure 3B:
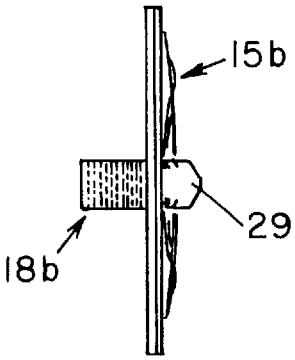
FIG. 3B is a side view of the accessory shown in FIG. 3A.
Figure 3C:
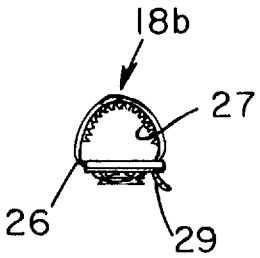
FIG. 3C is an end view of the accessory shown in FIGS. 3A and 3B.

A most preferred embodiment of the accessory is illustrated in FIGS. 3A–C and referenced by numeral 10B. The member 12*b* and associated clip 15*b* are the same as in the other embodiments. The member 18*b* however is different, in that it is adjustable in length, in order to clamp bows of different size. The member 18*b* includes an end 25 connected by live hinge 26, similar to hinge 20 in FIGS. 1A–B, to the member 12*b*. The member 18*b* includes teeth 27 projecting from an inner surface thereof generally towards the top surface of the member 12*b*. The teeth 27 serve to prevent bow slippage, similar to the teeth 24.

As best illustrated in FIG. 3A, the member 12*b* includes a slot 28 formed therethrough along one longitudinal edge opposite the hinge 26. The free end 29 of the member 18*b* includes a plurality of spaced notches 30 on each edge thereof which are adapted to engage with opposite ends of the slot 28 when the end 29 is inserted into the slot 28. Thus the length of the member 18*b* can be adjusted by pulling the free end 29 of the member 18*b* through the slot to the different spaced notches. The member 18*b* and the ridges formed by the notches are flexible so that the user can manually release the connection between the free end and the slot. Such a connection is similar to the ties that are quite often used to close off the ends of garbage bags.

Although the accessory 10 is shown as having a live hinge 20, a hinge similar to hinge 20*a* could be used. In addition, the teeth 24 and 27 could be used on either of the accessories 10,10A,10B, alone or in combination with each other.

Figure 4:
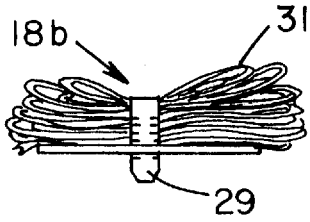
FIG. 4 is a view illustrating a bow being connected to the accessory.
Figure 5:
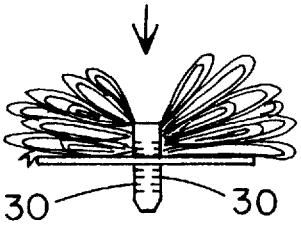
FIG. 5 is a view similar to FIG. 4, but showing the arcuate fastener being tightened so as to secure the bow.
Figure 6:
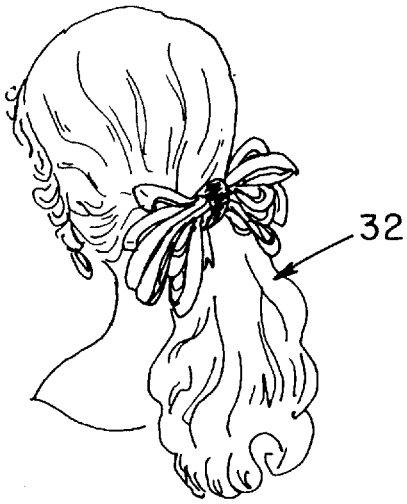
FIG. 6 is a view illustrating the accessory attached to the hair of a user.

In use, and referring to FIGS. 4–6, a length of ribbon 31 or an existing bow is disposed on the top surface of the accessory 10B, and the free end of the member is inserted through the slot 28. The free end is then pulled downward so as to clamp the middle of the ribbon/bow, as shown in FIG. 5. The clip 18*b* is then used to secure the accessory to the hair 32 of the user. If a different size, shape, or color of ribbon/bow is desired, the free end is released from the slot permitting removal of the old ribbon/bow and replacement with the new ribbon/bow.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair fashion accessory, comprising:

an elongated member having a first surface and an opposite, second surface;

clip means being adapted for securing the elongated member to a person's hair, said clip means being attached to said first surface;

fastening means for releasably securing a bow to the second surface of the elongated member, said fastening means being connected to a support member said fastening means being disposed generally above the second surface and extending generally orthogonally to a longitudinal axis of the elongated member; and a set of teeth formed on said second surface, said set of teeth projecting upward from said second surface, said set of teeth being for securely gripping the bow.

2. The hair fashion accessory of claim 1, wherein said fastening means comprises an arcuate member having a first end thereof connected by a hinge to the elongated member and a second end thereof releasably connected to the elongated member by attachment means for attaching said second end to said elongated member.

3. The hair fashion accessory of claim 2, wherein said hinge comprises a pivot pin.

4. The hair fashion accessory of claim 2, wherein said hinge comprises a live hinge.

5. The hair fashion accessory of claim 2, wherein said arcuate member is adjustable.

6. The hair fashion accessory of claim 5, wherein said attachment means comprises a slot formed through the elongated member from the second surface to the first surface, said second end of the arcuate member including a plurality of spaced notches which engage with opposite ends of the slot when the second end is inserted into the slot.

7. The hair fashion accessory of claim 1, further comprising a second set of teeth formed on said fastening means and projecting therefrom in a direction generally toward said second surface, said second set of teeth being for securely gripping the bow.

8. A hair fashion accessory, comprising:

an elongated member having a first surface and an opposite, second surface;

clip means being adapted for securing the elongated member to a person's hair, said clip means being attached to said first surface;

fastening means for releasably securing a bow to the second surface of the elongated member, said fastening means being connected to a support member, said fastening means being disposed generally above the second surface and extending generally orthogonally to a longitudinal axis of the elongated member; and a set of teeth formed on said fastening means and projecting therefrom in a direction generally toward said second surface, said set of teeth being for securely gripping the bow.

9. A hair fashion accessory, comprising:

an elongated member having a first surface and an opposite, second surface;

clip means being adapted for securing the elongated member to a person's hair, said clip means being attached to said first surface;

fastening means for releasably securing a bow to the second surface of the elongated member, said fastening means being connected to a support member, said fastening means being disposed generally above the second surface and extending generally orthogonally to a longitudinal axis of the elongated member;

wherein said fastening means comprises an arcuate member having a first end connected by a hinge means for connecting said fastening means to the elongated member, said fastening means having a second end releasably connected to the elongated member by attachment means for holding the fastening means in a closed position defined by said second end being engaged to said elongated member;

a set of teeth formed on said second surface, said set of teeth projecting upward from said second surface, said set of teeth being for securely gripping the bow;

wherein said hinge means is a hinge type chosen from the group of hinge types consisting of a pivot hinge and a live hinge;

wherein said attachment means comprises a slot formed through the elongated member from the second surface to the first surface, said second end of the arcuate member including a plurality of spaced notches which engage with opposite ends of the slot when the second end is inserted into the slot; and a second set of teeth formed on said fastening means and projecting therefrom in a direction generally toward said second surface, said second set of teeth being for securely gripping the bow.

* * * * *